US005584480A

United States Patent [19]

Grimsrud

[11] Patent Number: 5,584,480

[45] Date of Patent: Dec. 17, 1996

[54] PORTABLE SPORTS TARGET FRAME

[76] Inventor: Chris A. Grimsrud, P.O. Box 393, Wolf Point, Mont. 59201

[21] Appl. No.: 507,662

[22] Filed: Jul. 25, 1995

[51] Int. Cl.[6] ..... A63B 63/04; A63B 63/08

[52] U.S. Cl. ..... 273/1.5 R; 273/26 A; 273/55 B; 273/55 D; 273/57.2; 273/58 C; 273/396; 273/407; 273/413; 473/197

[58] Field of Search ..... 273/1.5 RA,26 A, 273/55 BD, 394, 395, 396, 398, 400, 402, 406, 407, 413, 57.2, 58 C

[56] References Cited

U.S. PATENT DOCUMENTS

| | | | |
|---|---|---|---|
| 1,304,602 | 5/1919 | Reid | 273/406 |
| 2,125,679 | 8/1938 | Longstreet | 273/55 |
| 2,862,712 | 12/1958 | Delia et al. | 273/26 E |
| 3,051,491 | 8/1962 | Cabot | 273/200 R |
| 3,427,026 | 2/1969 | Mahoney | 273/1.5 A |
| 3,602,504 | 8/1971 | Chapman et al. | 273/1.5 R |
| 3,675,922 | 7/1972 | Nieland | 273/55 |
| 3,806,122 | 4/1974 | Jones | 273/95 |
| 3,819,183 | 6/1974 | Crowder | 273/98 |
| 3,820,787 | 6/1974 | Heinbigner | 273/55 |
| 4,147,353 | 4/1979 | Moore | 273/413 |
| 4,350,338 | 9/1982 | May | 273/55 B |
| 4,927,145 | 5/1990 | Davis | 273/94 |
| 4,991,840 | 2/1991 | Patton | 273/55 |
| 5,088,732 | 2/1992 | Kim | 273/29 A |
| 5,120,055 | 6/1992 | McCarthy et al. | 273/57.2 |

*Primary Examiner*—William H. Grieb

*Attorney, Agent, or Firm*—Wells, St. John, Roberts, Gregory & Matkin, P.S.

[57] ABSTRACT

A portable sports target frame is described for numerous sports games in which a projectile such as a ball or puck is used. The target frame includes an elongated cross member with uprights mounted at opposed ends. The uprights are mounted by an angular adjustment that enables selective pivotal adjustment of the uprights to positions simulating different sports targets. The cross member is held in the selected angular position by a parallelogram linkage including base standards and a parallel stabilizing link mounting the elongated cross member to a base for pivotal movement while maintaining the uprights in selected angular orientations. A latch is mounted between the linkage and base to permit selective angular positioning of the base standard relative to a platform. A ball or other projectile may be mounted to the platform by a tether which includes an elastic part secured to the projectile and an inelastic part extending to the projectile. The tether is long enough to allow the projectile to be thrown, kicked, or struck into a net suspended between the uprights. The elastic part is provided to return the projectile to the user.

23 Claims, 10 Drawing Sheets

PORTABLE SPORTS TARGET FRAME

TECHNICAL FIELD

The present invention relates to portable sports targets, and more particularly to a portable target frame that is adjustable to different positions for different sports activities, and for simulating different target distances.

BACKGROUND OF THE INVENTION

Sports targets or goals are often used in practice or actual competition in games such as football, soccer, hockey, basketball, tennis, baseball, golf, etc. In such games as football, soccer and hockey, the targets or goals are often quite large and often mounted as a permanent fixture on the playing field. Practice kicking a ball through the goals must be done on the field. It is not often convenient for the players to practice or compete, since the fields are often in use or are some distance away. A solution to this problem is to obtain a portable goal.

Players wishing to practice games such as tennis, baseball, and golf can also benefit from use of a portable target, especially one that will return a thrown or struck ball to the player.

Portable goals have been developed, either for football or soccer, but, to the inventor's knowledge, none have been developed for multiple sports. Further, the space in which practice may be permitted is typically not sufficient for full scale practice.

A need has thus developed for a reduced scale sports target frame that can be adjusted to simulate various target distances, and that can be converted for competition or practice of numerous sports. A need also exists for reducing the tedium experienced by sports players who must typically chase the ball, puck or other device after a practice swing, kick, or throw.

The present invention fills the above needs by providing a sports target frame that can be converted to simulate target distance, and that can be adjusted to present a target for competition or practice in a number of different sporting activities. The present invention also eliminates the tedium of chasing thrown, or struck projectiles by returning the projectiles to the user for further practice or competition. These and further objects and advantages will become apparent from the following description and accompanying drawings.

BRIEF DESCRIPTION OF THE DRAWINGS

Preferred embodiments of the invention are described below with reference to the accompanying drawings, which are briefly described below.

FIG. 9 is a side view of a preferred sports target frame with a ball, a tether, and a platform mounted to the goal base, along with examples of various sports projectiles that may be used with the target frame;

DETAILED DESCRIPTION OF THE PREFERRED EMBODIMENTS

Figure 1:
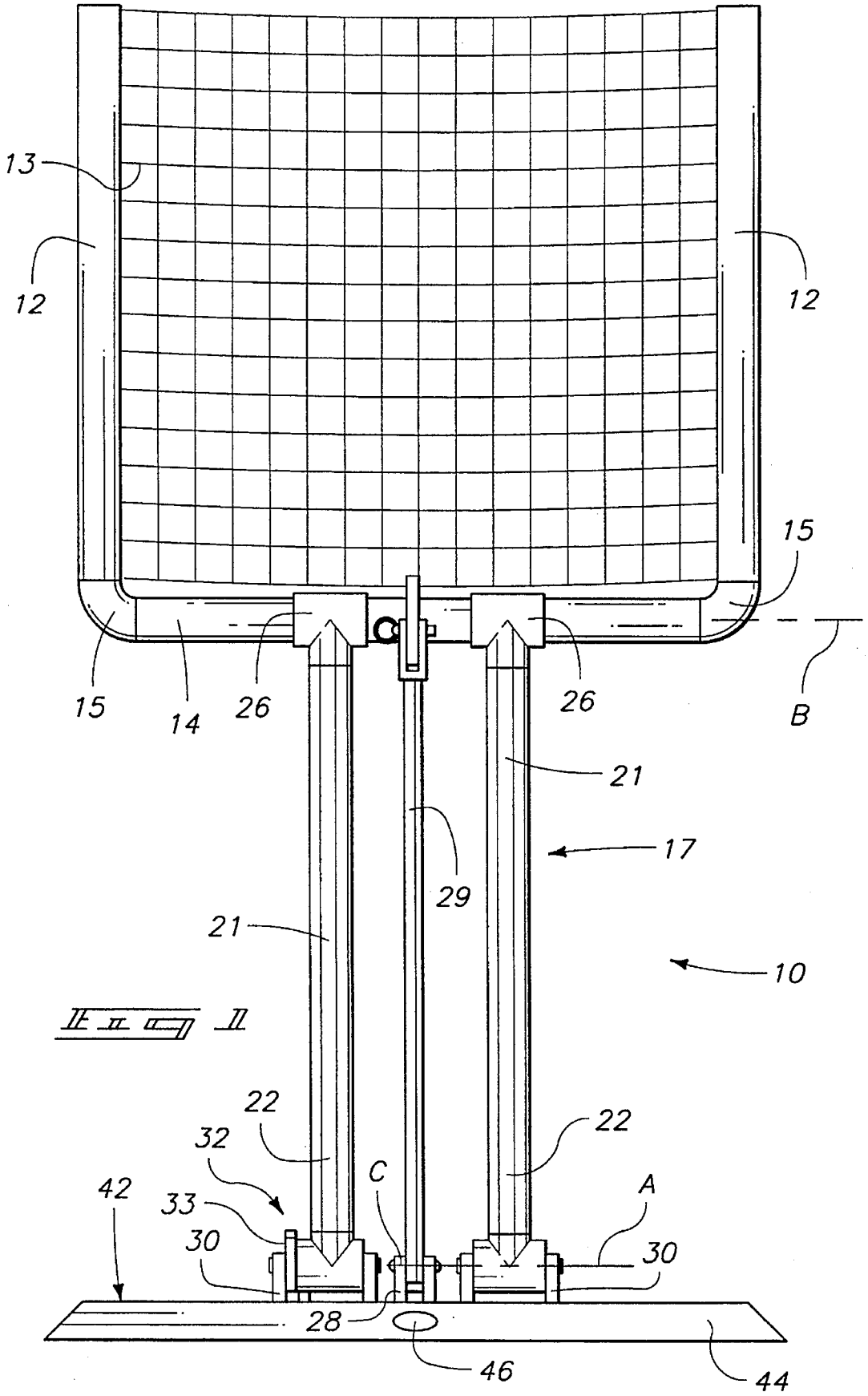
FIG. 1 is a frontal view of a preferred sports target frame of the present invention including a platform support.

This disclosure of the invention is submitted in furtherance of the constitutional purposes of the U.S. Patent Laws "to promote the progress of science and useful arts" (Article 1, Section 8).

A portable sports target frame embodying preferred features of the present invention is exemplified in the drawings and is identified therein by the reference numeral 10. The present target frame is intended for use in practice or competition in multiple sports where a projectile is used as a game piece. Thus, the term "projectile" 11 should be understood to include footballs, soccer balls, baseballs, basketballs, golf balls, volleyballs, hockey pucks, and any other thrown or struck object used as a gamepiece in a sport.

To avoid unnecessary redundancy in description of elements in the present invention, the following detailed description will be given primarily in terms of the frame being used as a football goal, then as a soccer goal. The inventive elements for both of these representative configurations are the same, as they are for other configurations (described below) used for different sports.

It is also noted that the present sports target frame 10 can be produced, sold and used with different attachments. Firstly the sports target frame 10 can be produced, simply as a goal assembly, capable of being anchored to the ground by spikes or weights. The frame 10 can also be produced with or without a specific attached target, or be provided with or without a platform (FIGS. 1 and 9) and a projectile (such as a football, baseball, hockey puck, soccer ball, etc.) as a complete practice and game playing assembly as shown in FIG. 9.

For convenience of initial description, the target frame 10 will first be described as adjusted between two configurations: (1) a football goal, and (2) a soccer or hockey goal. In either or both configurations, a projectile 11 such as a football or soccer ball may be provided to be kicked toward a target area which in the preferred embodiment is defined by a pair of uprights 11 supporting a net 13 adjacent a cross member 14.

Brackets 15 mount the uprights 12 to the cross member 14. In a preferred form, they are "L" socket members fitted to ends of the cross member 14 and receiving the uprights 12. The uprights may be either secured permanently to the brackets, or be removable to reduce the overall size of the target frame 10 to facilitate storage.

In a basic preferred form, the present sports target frame is pivotably adjustable about a first substantially horizontal axis A (FIGS. 1, 2), advantageously by way of at least one and more preferably a pair of base standards 21 which include top end brackets 26 rotatably mounting the cross member 14 and a bottom end 22 pivotably mounted about axis A by a connector 30 to a support base 18. The base 18 may function alone as a support platform that, for example, can be affixed to the ground with spikes.

In a more specific form, the cross member is adjustably supported by a preferred parallelogram linkage arrangement shown generally at 17. The parallelogram linkage mounts the elongated cross member 14 to the base 18 for pivotal movement and maintains the uprights in substantially upright orientations, as may be understood by comparing FIGS. 2, 3, and 4.

The preferred linkage 17 includes the base standards 21 which extend from the base connectors 30 upwardly to cross member fittings 26 at the top standard ends 23. The fittings 26 are "T" shaped, with their upright legs affixed to the top ends 23 of the base standards 21, and the horizontal legs rotatably mounting the cross member 14. The fittings 26 and cross member 14 thus define a second horizontal axis "B" that is substantially parallel to and spaced from the first axis "A" by a first distance (graphically identified in FIG. 10 by the letter "W").

Figure 8:
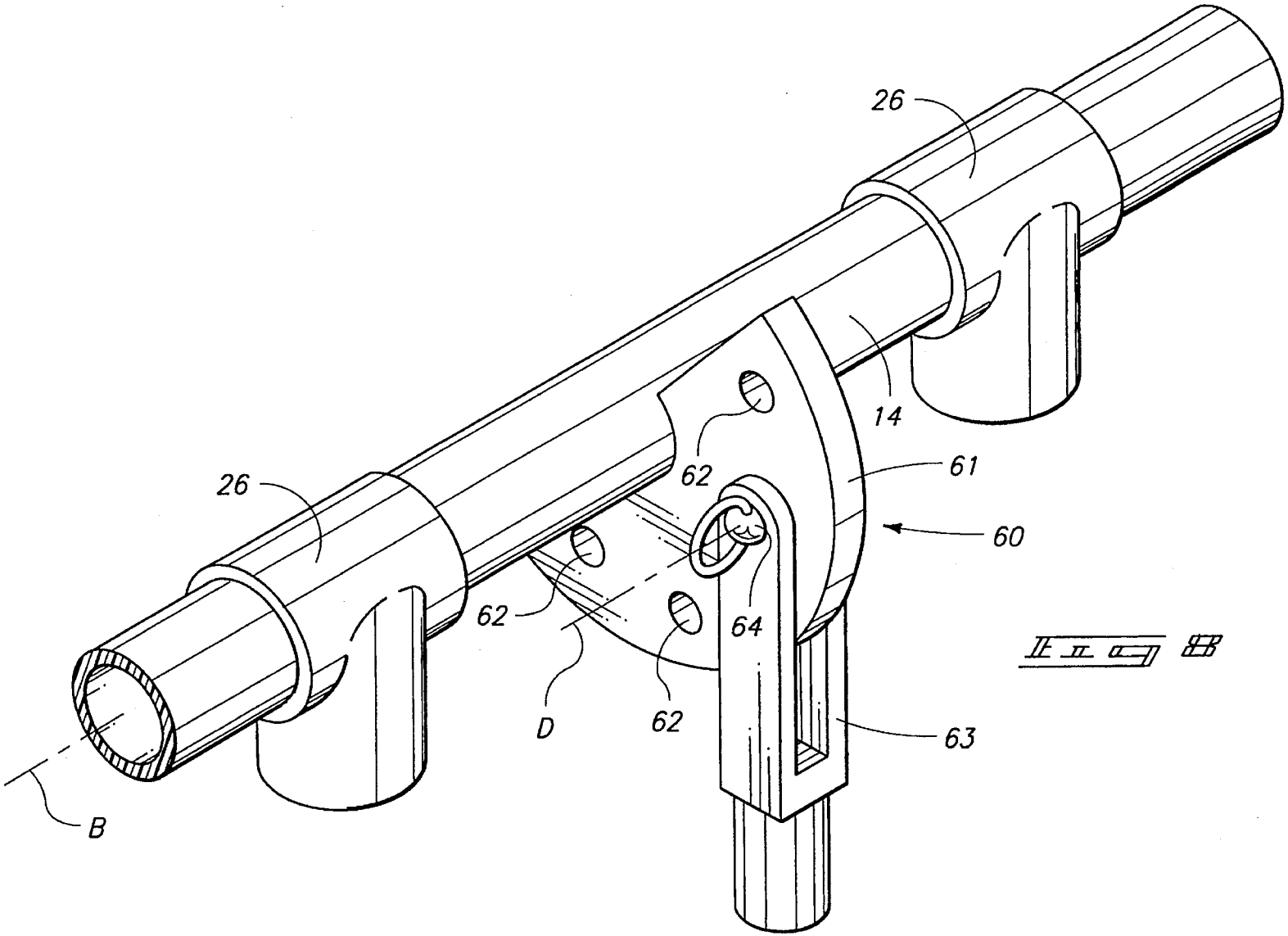
FIG. 8 is an enlarged fragmented perspective view illustrating a preferred cross member fitting and a pair of parallelogram connectors on the cross member.

Linkage 17 also includes at least one stabilizing link 29 mounted to the base by a connector 28. The link 29 is substantially centered between the base standards as shown in FIG. 1 and partially in FIG. 8. This relationship provides ample bracing for the goal against a projectile being forcefully received in the net 13. Link 29 is also mounted at its upper end to the cross member 14 by an angular adjustment means 60 (to be described in greater detail below).

The connector 28 and means 60 define third and fourth axes "C" and "D" that are substantially parallel to the first and second axes "A" and "B". Connector 28 is affixed to the base 18 and connector means 60 located at the cross member 14. The means 60 pivots the cross member 14 within the fittings 26, so the uprights 12 are always held at a consistent selected angle. This angular relationship is held consistent by the parallelogram geometry which will be explained in greater detail below with reference to FIG. 10.

Figure 6:
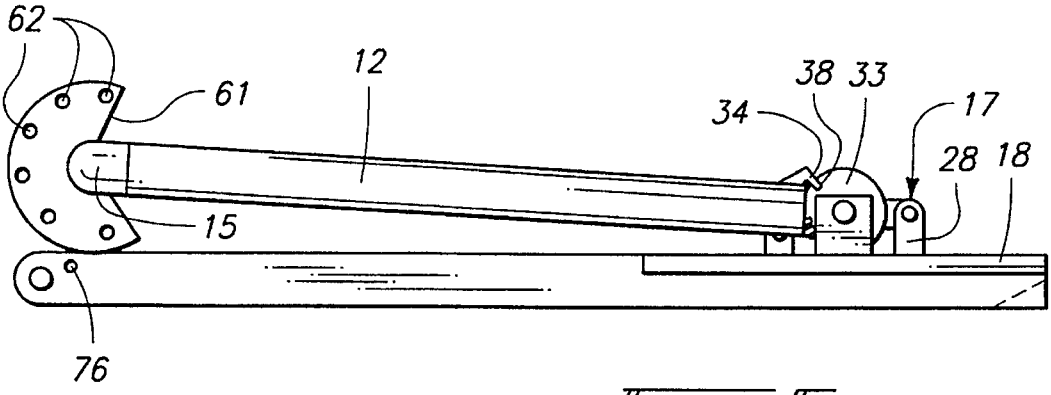
FIG. 6 is a side view of a parallelogram linkage and platform for the target frame folded, storage condition.
Figures 6, 7, 10:
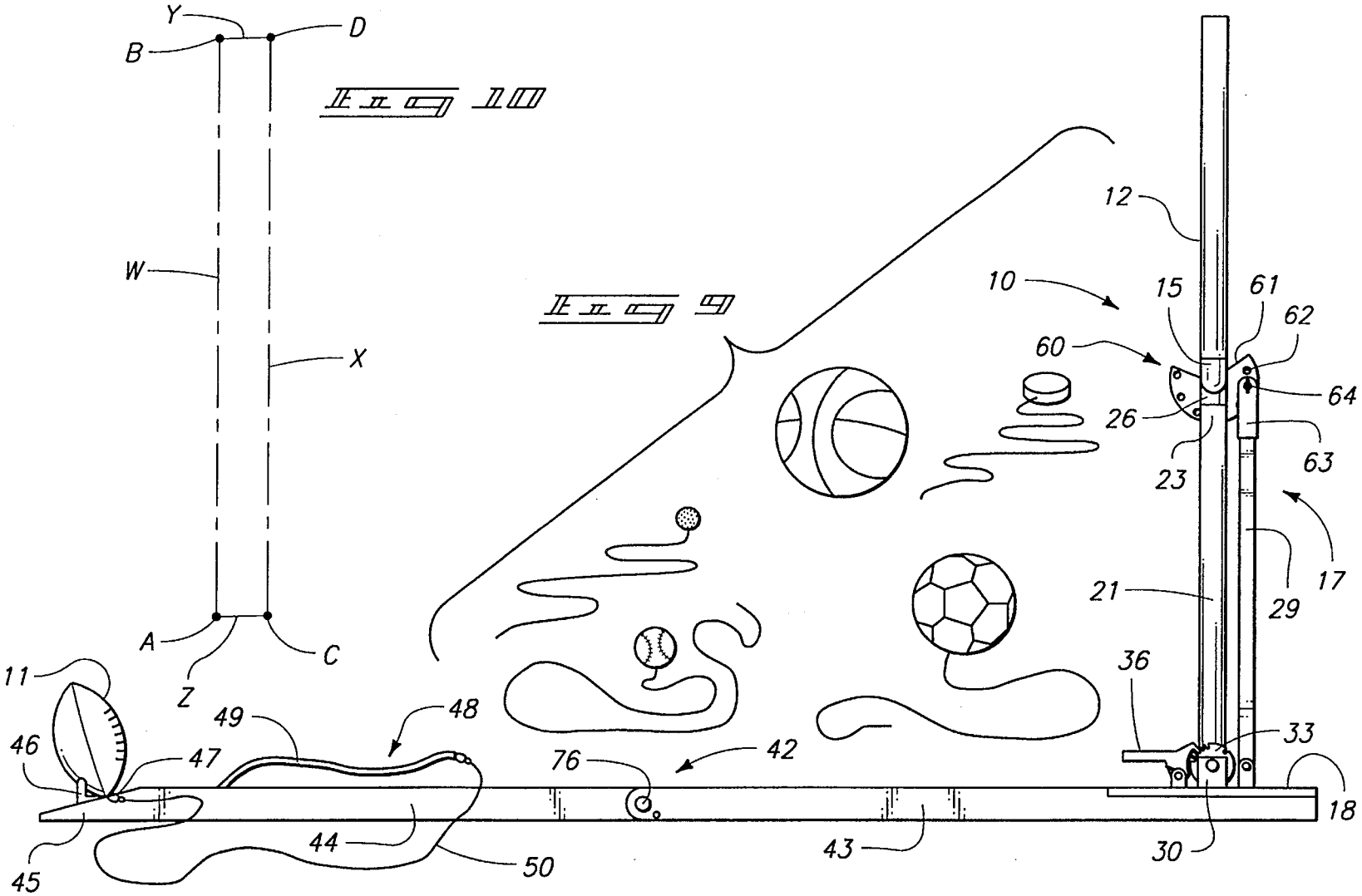
FIG. 10 is a diagram of the geometry of the parallelogram linkage of the preferred sports target frame.

The various axes "A"–"D" and first through fourth distances "W"–"Z" are diagrammatically shown in FIG. 10, forming a parallelogram. A first distance "W" between axes "A" and "B" is substantially equal to a second distance "X" between third and fourth axes "C" and "D". Likewise, a third distance "Z" between first axis "A" and third axis "C" is substantially equal to a fourth distance "Y" between second axis "B" and fourth axis "D".

Figure 2:
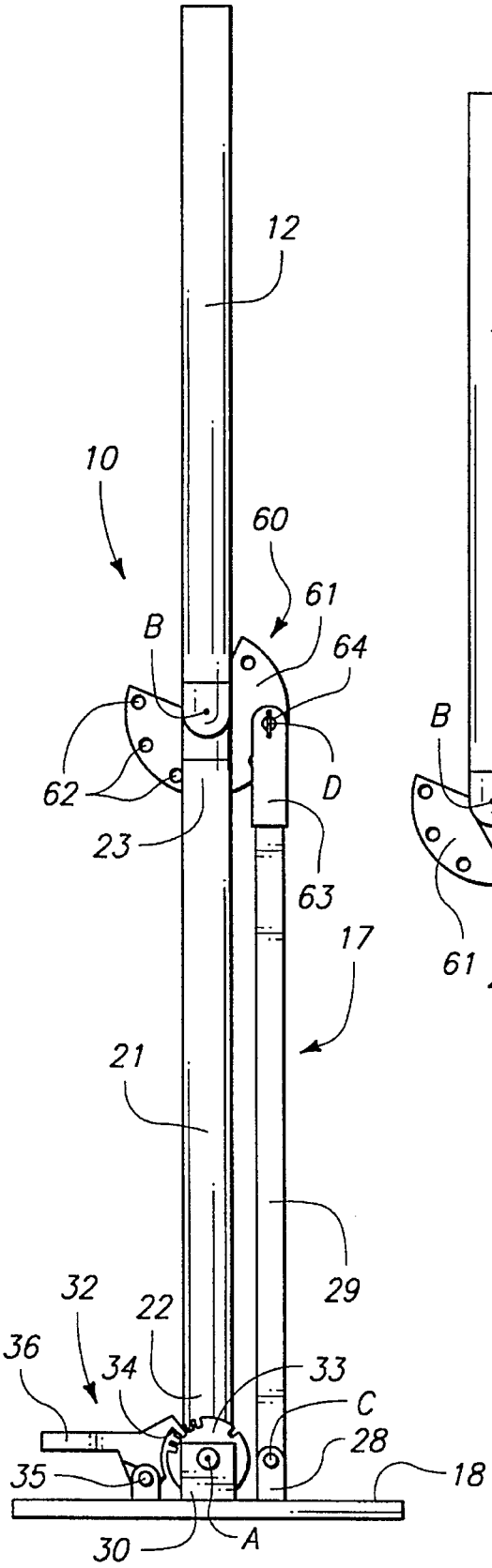
FIG. 2 is a side view of the target frame shown in FIG. 1 without the platform.
Figure 3:
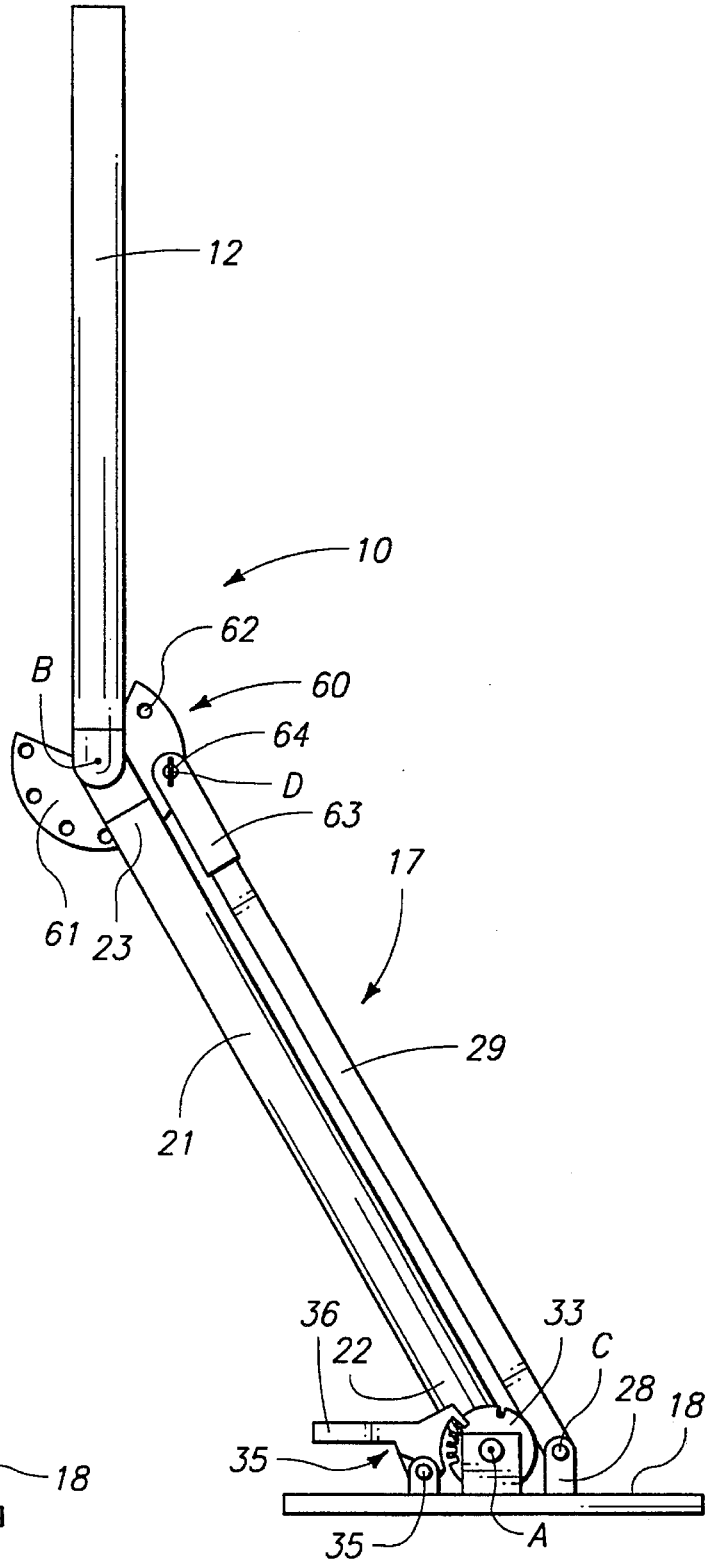
FIG. 3 is another side view of the target frame in a forward angular adjusted position.
Figure 4:
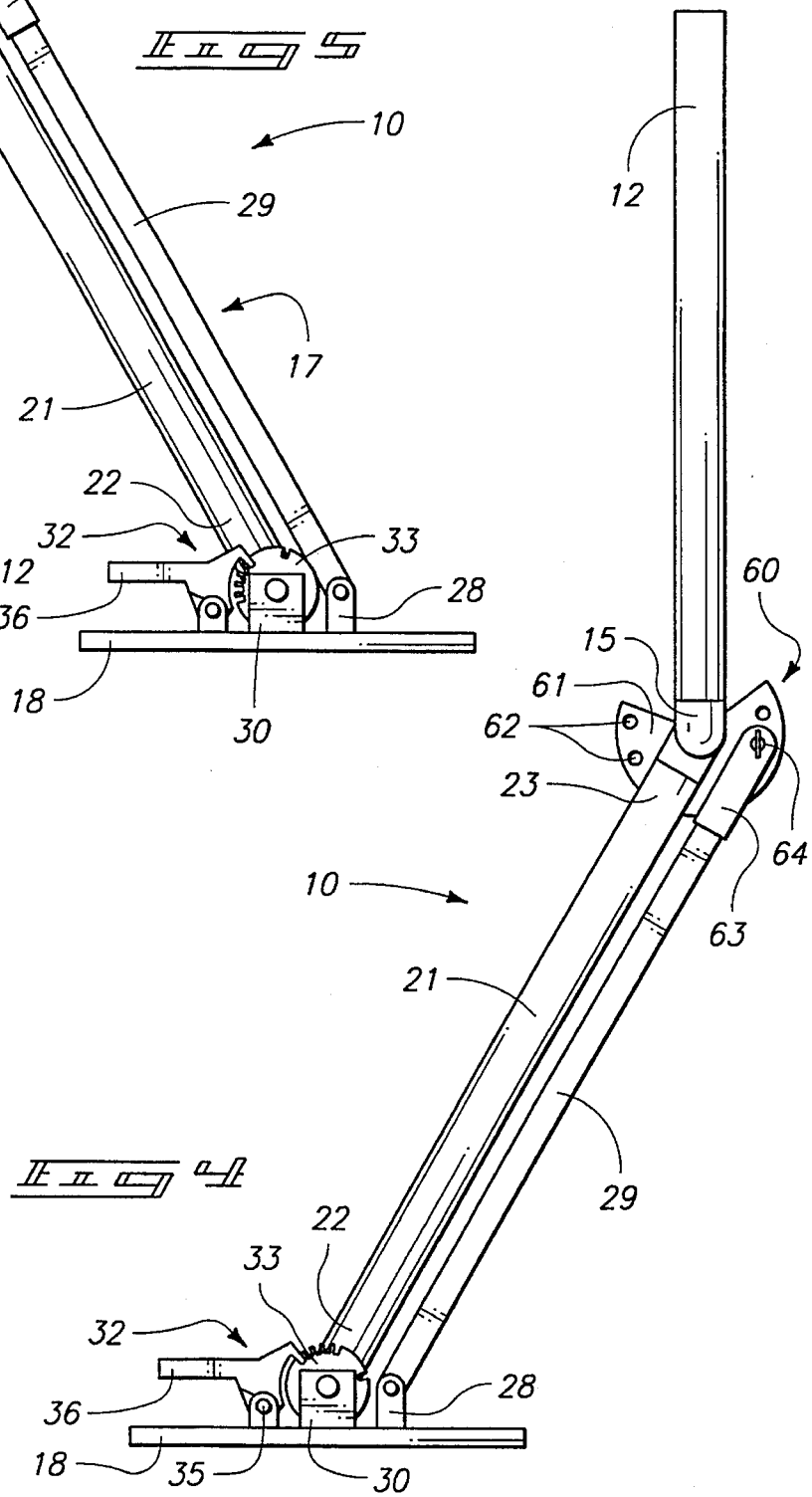
FIG. 4 is another side view of the target frame in a rearward angular adjusted position.

The above geometry, with the first and third axes "A" and "C" pivotably anchored by the connectors 28 on the base, allows pivotal adjustment of the uprights back and forwardly with the uprights remaining substantially vertical as shown in FIGS. 2–4.

By adjustment of the linkage 17 forward or rearwardly, the uprights are placed nearer or further from a fixed, say, kicking point (for football), with the distance from the kicking point to the base 18 remaining constant. Different sports target distances are thus capable of being simulated while the realism of the horizontal cross member and vertical uprights is maintained.

Figure 7:
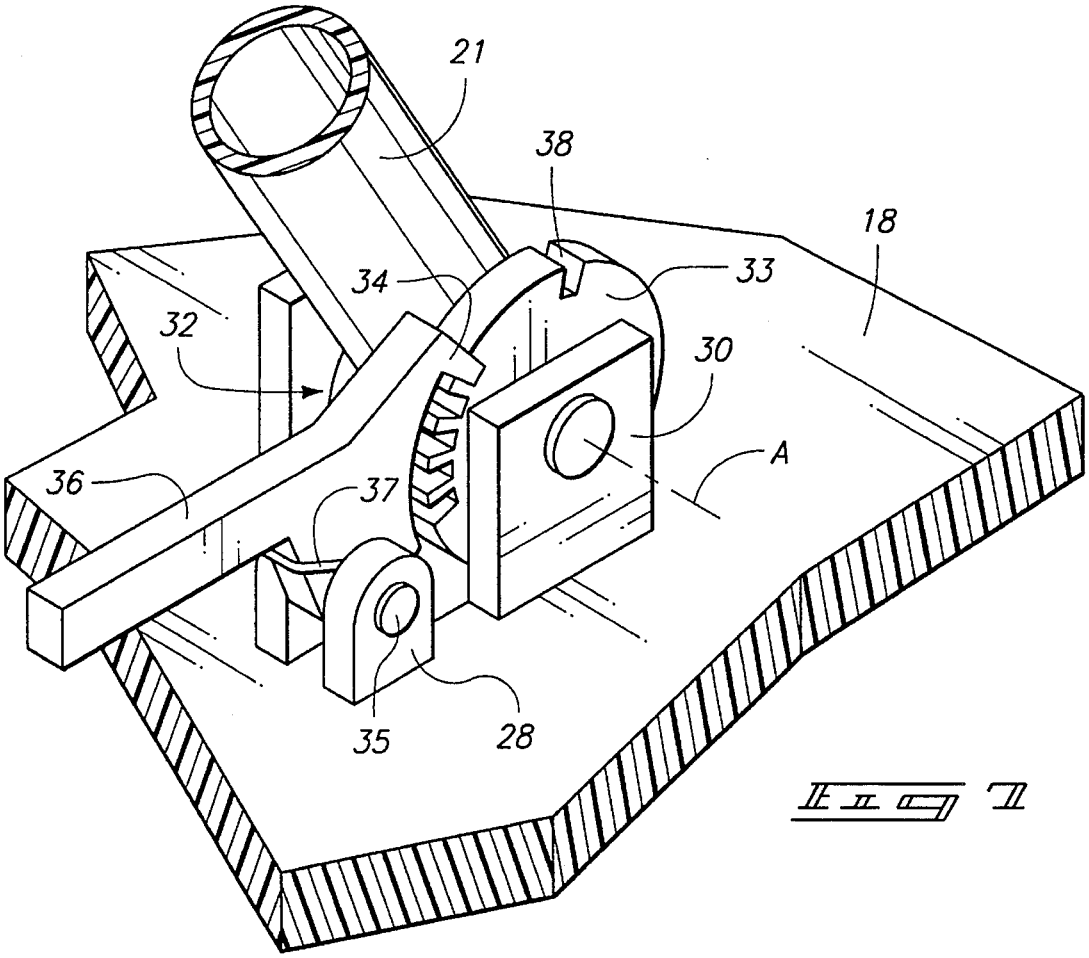
FIG. 7 is an enlarged fragmented perspective view illustrating a preferred latch for selectively angularly adjusting the sports target frame.

A latch 32 is preferred to enable selective angular adjustment of the linkage 17 to simulate various target distances, and to lock the linkage 17 at the selected setting. Latch 32 is best described with reference to FIG. 7 where a cog wheel 33 with angularly spaced notches is affixed to one of the standards 21.

A locking dog 34 (FIG. 7) is mounted to the base 18 at a pivot 35 that is advantageously common or coaxial with the third axis "C". A torsion spring 37 normally urges the locking dog 34 to engage and lock in a selected notch along the cog wheel 33. A pedal 36 projects to one side of the pivot 35 that may be depressed to lift the locking dog 34 from engagement with the cog wheel. By depressing the pedal 36, the user is allowed to pivotably adjust the linkage 17, cross member 14 and uprights 12 to a new selected angular position.

One of the notches 38 on the cog wheel is positioned to engage and interlock with the locking dog 34 when the assembly is folded closed for transport and storage as shown in FIG. 6.

The number and spacing of notches on the cog wheel 33 is selected according to the number of adjustment increments representing simulated sports target distances or frame configurations that are desired. For example five notches are shown, corresponding with five angular positions, which in turn relate to five different settings. Several settings are shown diagrammatically in FIGS. 14–17 and in more detail in FIGS. 2–6. More or fewer of the notches might be provided, according to the intended usage. These settings, combined with adjustable features for the uprights to be described below, allow the present sports target frame 10 to be configured by the user in a wide number of positions for a wide variety of sport activities.

FIG. 9 shows a platform 42 included with the present sports target frame 10, as an extension of the base 18. The platform 42, in a preferred form is provided in a minimum of two interfitting sections 43, 44. The sections are hinged and will fold on one another to facilitate storage or to further extend the range of usage for the target frame 10 (see FIG. 11 for example). It is preferred that the base 18 be mounted to one of the platform sections 43.

The platform 42 extends to one side of the base 18. It includes a remote end 45 on section 44 that is inclined or beveled to the ground or floor surface. The elongated sides of the platform sections 43, 44 may also be similarly inclined.

The top surface of the platform is flat and, if desired, may be covered with an artificial grass mat to simulate an actual playing field. Lines indicating yard marks (not shown) can also be spaced along the platform, again to simulate an actual playing field.

Figure 5:
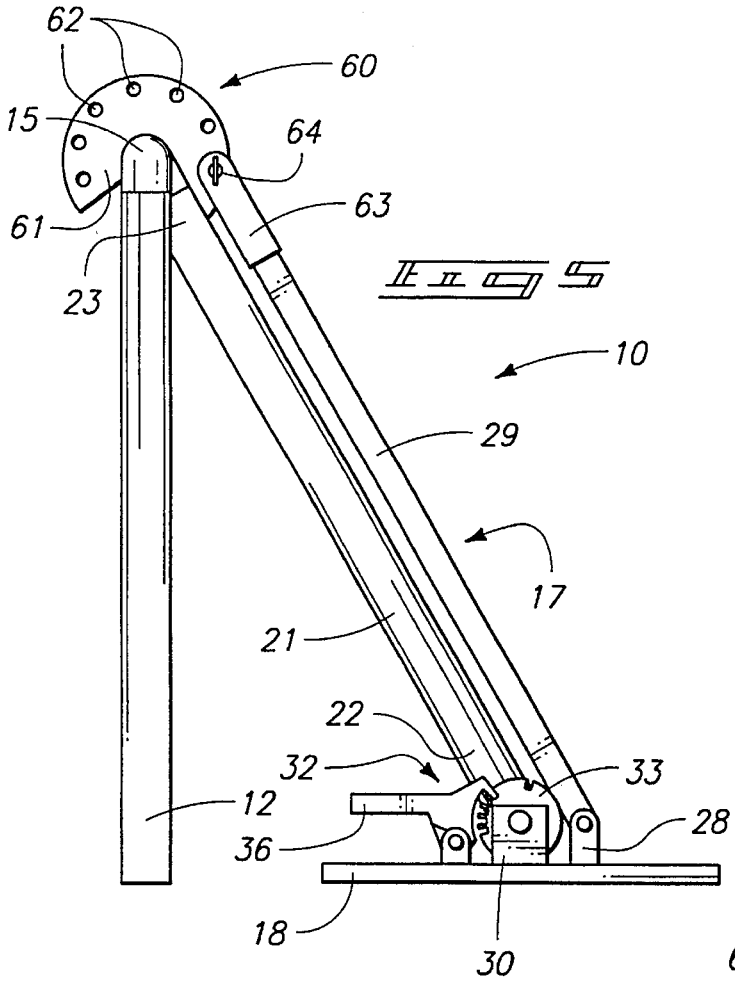
FIG. 5 is a side view of the target frame adjusted in a lowered condition.

Platform section 44 includes access for releasably mounting a kicking tee 46 that is removable, leaving a smooth surface that permits the platform 44 to be used for soccer goal kicking or hockey practice (with the remainder of the target frame arranged as shown in FIG. 5). The tee 46 is preferably similar to a conventional football kicking tee.

At least one projectile is provided in a preferred embodiment, connectable to the platform 42 by a tether 48. Other tethered projectiles may also be provided as exemplified in FIG. 9.

In general the tether 48 is a flexible cord with a length dimension at most equal to a distance from the platform end 45 or ball tee 46 to the cross member 14 (when located in the forward most position as shown in FIG. 3). This length can be extended when the projectile is kicked, thrown, or struck toward the target, by provision of an elastic part 49 of the tether.

In a preferred form, one end of the elastic part 49 is connected to the platform. The other end is connected to an inelastic part 50. The inelastic part 50 extends the remainder of the tether length, from the elastic part 49 to the projectile.

Different projectiles are useable with the present target frame and can be interchanged by provision of a simple conventional snap clip and loop connector assembly 47 (FIG. 9) between the end of the tether and the projectile. For example, a football or a soccer ball may be interchangeably mounted to the tether 48 as shown loose on the platform in FIG. 9.

The elastic part 49 of the tether is resilient, and formed by a material such as rubber. It has sufficient length and resiliency stretch and allow the ball to pass beyond the uprights and into the net. The elastic part 49 will then retract, returning the ball to an area adjacent the ball tee 46. The user therefore does not have to chase the ball after each kick.

The target is provided in one preferred form as a net 13 of woven cord that is somewhat elastic yet strong to resiliently withstand impact by a projectile. The net is situated between the uprights simply to prevent the tether 48 from winding about the cross member or uprights. Since the elastic part 49 of the tether functions to return the projectile, no special provisions are required for the net 13 to spring the ball back. Of course the net will have some rebound effect and will function to assist in returning projectiles toward the user, even if no tether is used.

Further adjustment of the angular position for the uprights 12 and net 13 is available through use of the adjustment means 60 shown in FIGS. 2–6 and 8. In a presently preferred form, means 60 includes a semi-circular flange 61 mounted rigidly to the cross member 14 at its approximate center and in a plane normal to the axis B. The flange 61 is provided with angularly spaced holes 62. A clevis 63 at the upper end of stabilizing link 29 fits loosely over a part of the flange 61 and includes apertures receiving a pin 64 (defining axis D). The pin 64 is removably receivable through the clevis 63 any one of the holes 62.

The angular position of the uprights may be selectively adjusted by removing the pin 64 and rotating the uprights on axis B until the selected angle is obtained. The pin 64 is then slid back through the clevis and one of the holes 62 that is then aligned with the clevis apertures.

Figure 15:
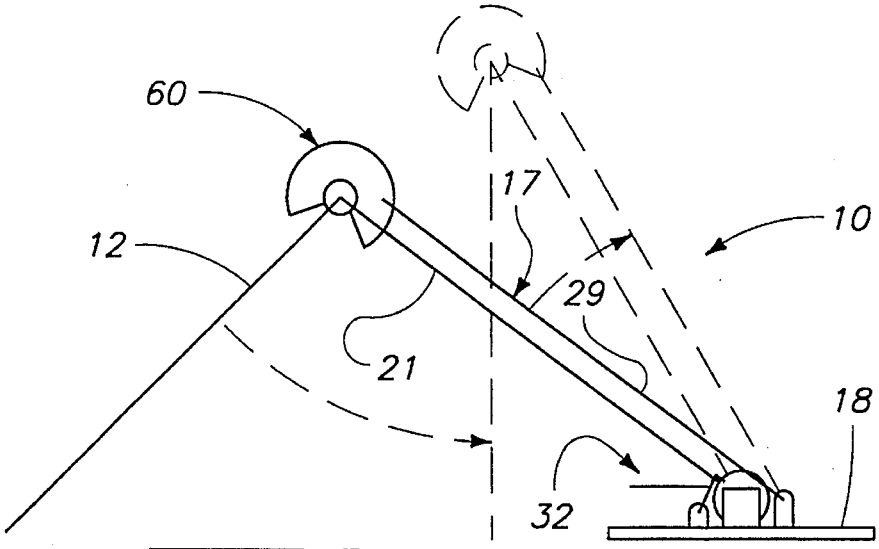
Figure 16:
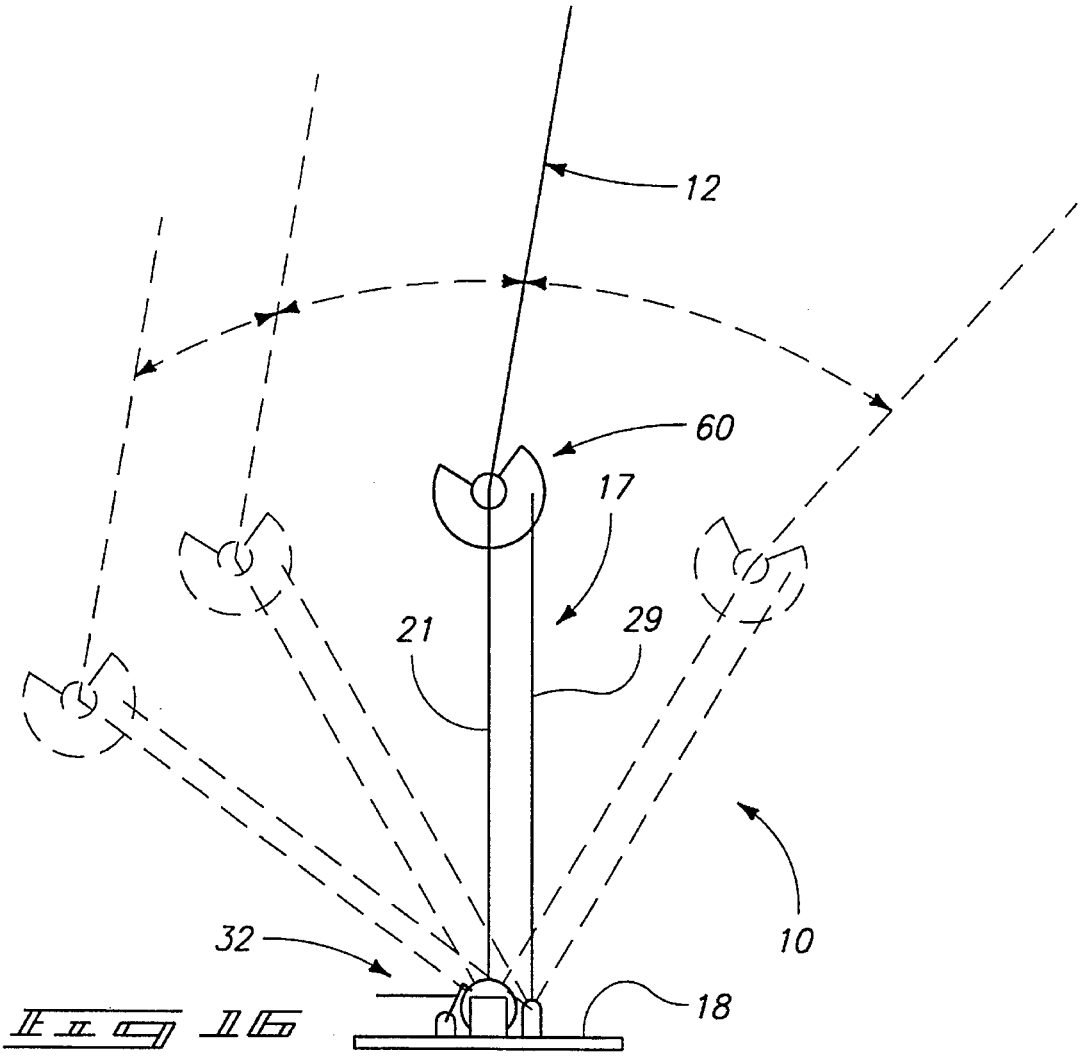
Figure 17:
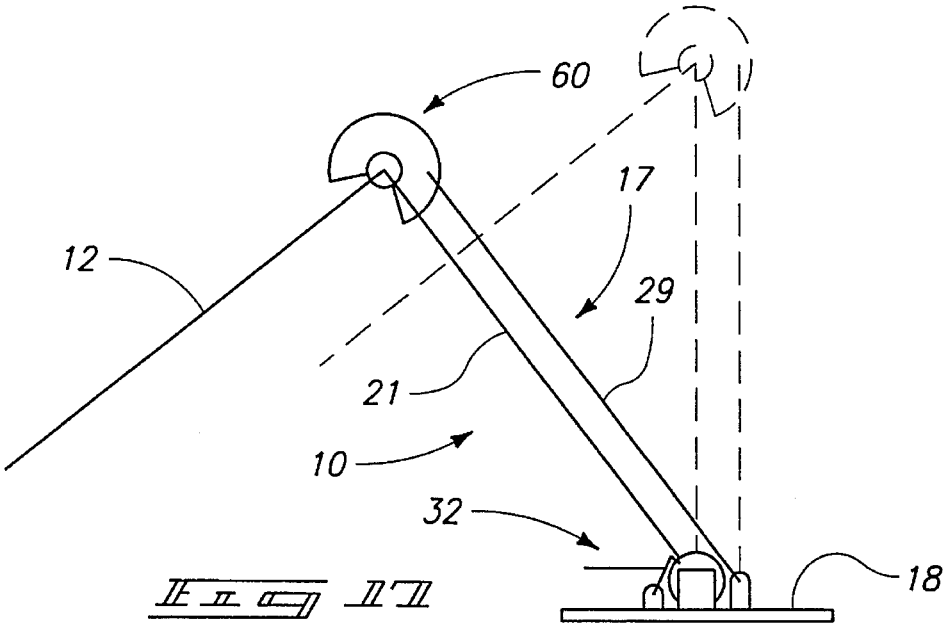

The selected angular position of the uprights 12 is now locked in, and will remain consistent (due to the parallelogram linkage) throughout adjustment of the standard 21, as graphically illustrated in FIGS. 15–17. This allows for adjustment to accommodate use of the present sports target frame for practice and competition for other games. For example, baseball pitching can be practiced using various heights and angles of the net for a variety of "strike zones". The target frame 10 may also be adjusted, to a height as shown in FIG. 11 using part of the platform 42 as a basketball backdrop frame.

Figure 11:
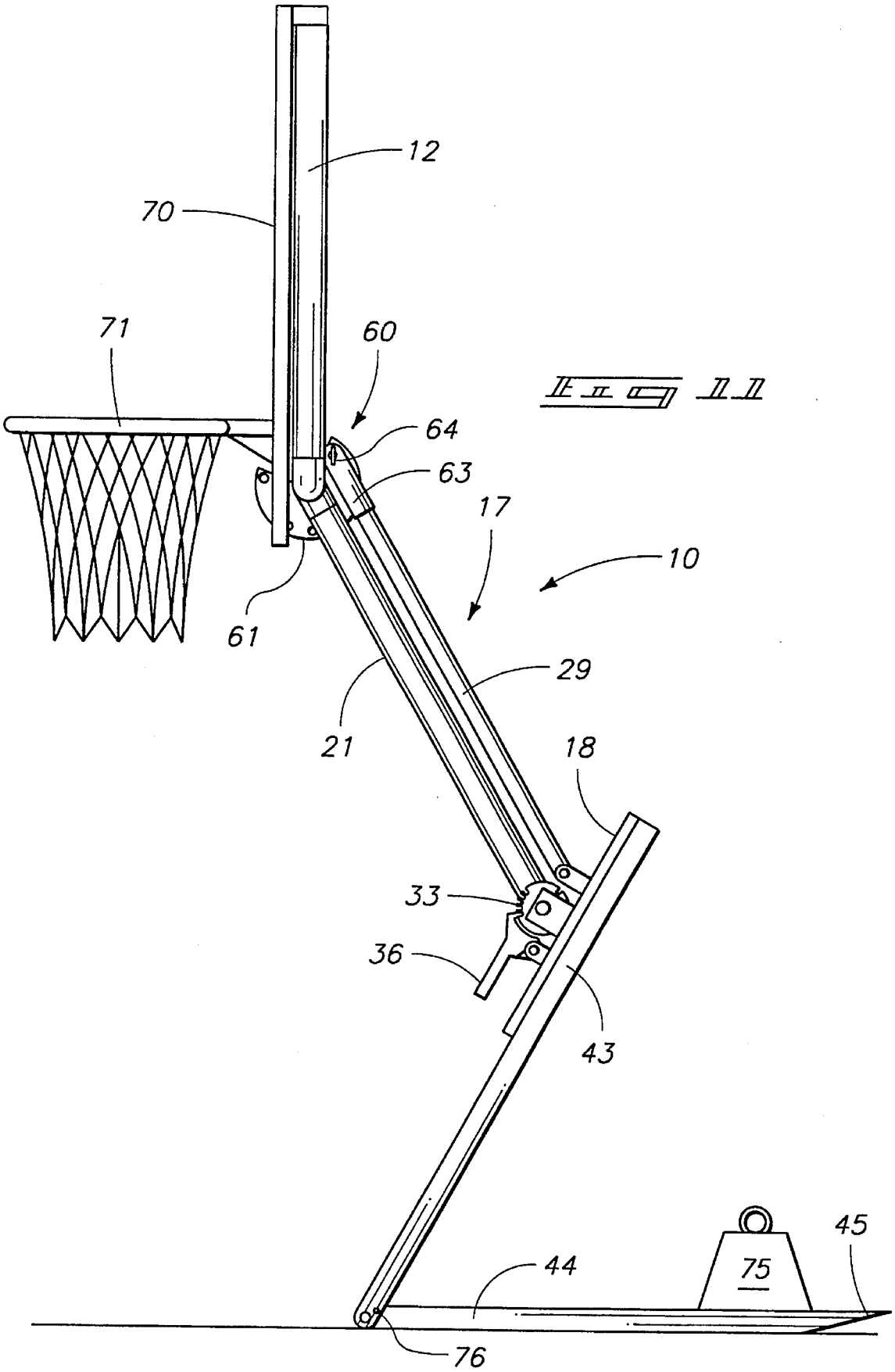
FIG. 11 is a side view of the preferred target frame arranged as a basketball goal.
Figure 12:
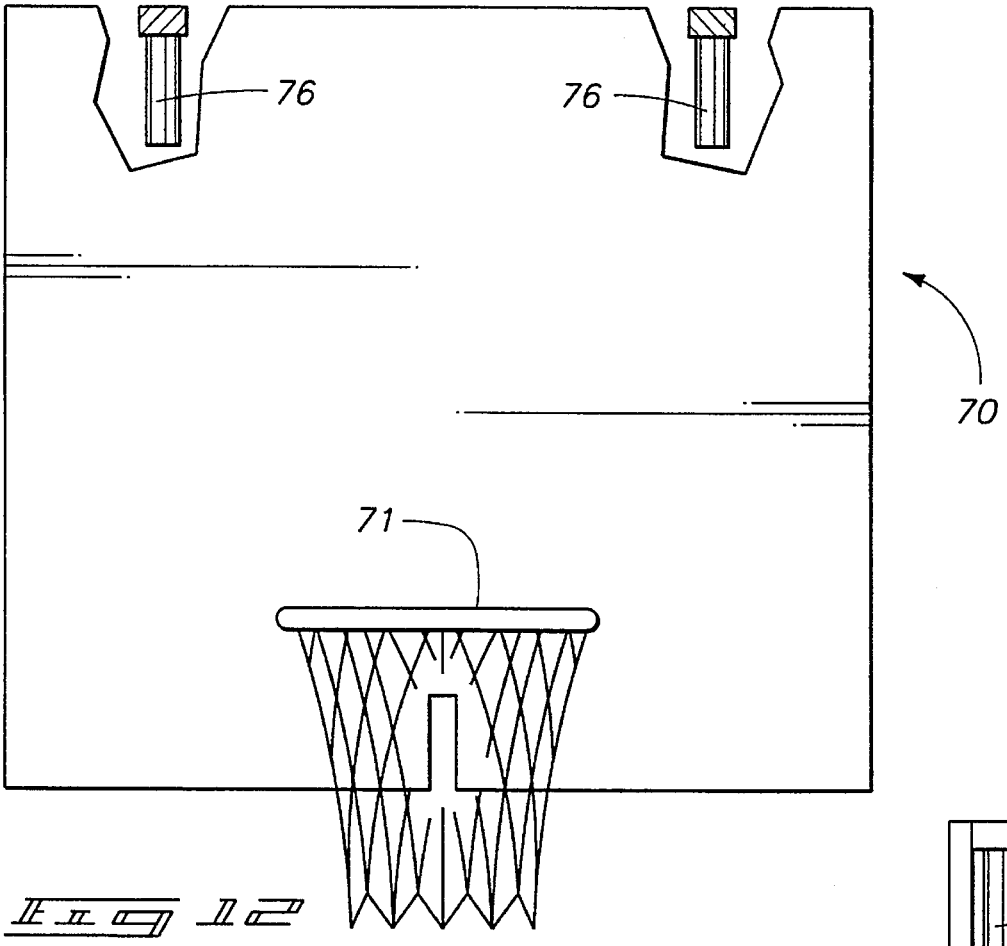
FIG. 12 is a fragmented frontal view of a basketball back stop and basket for use with the present target frame.
Figure 13:
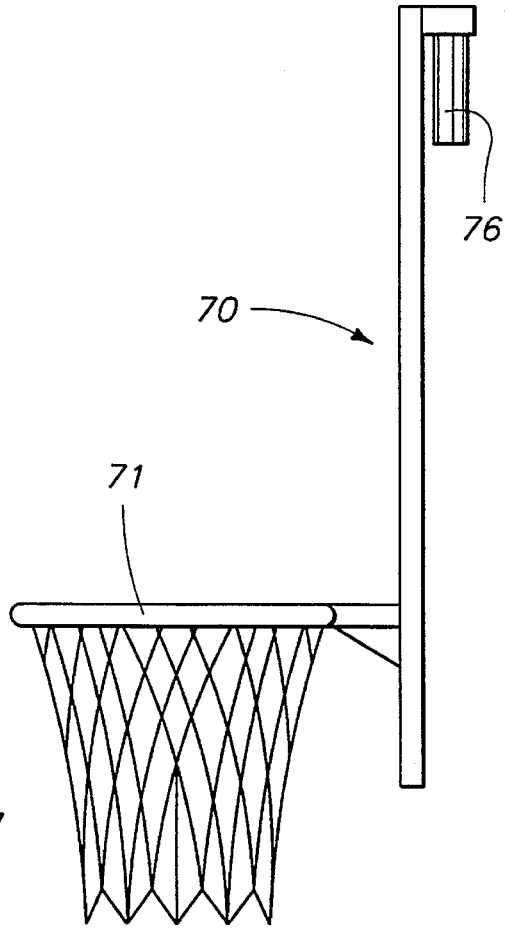
FIG. 13 is a side view of the basketball back stop and basket shown in FIG. 12.
Figure 14:
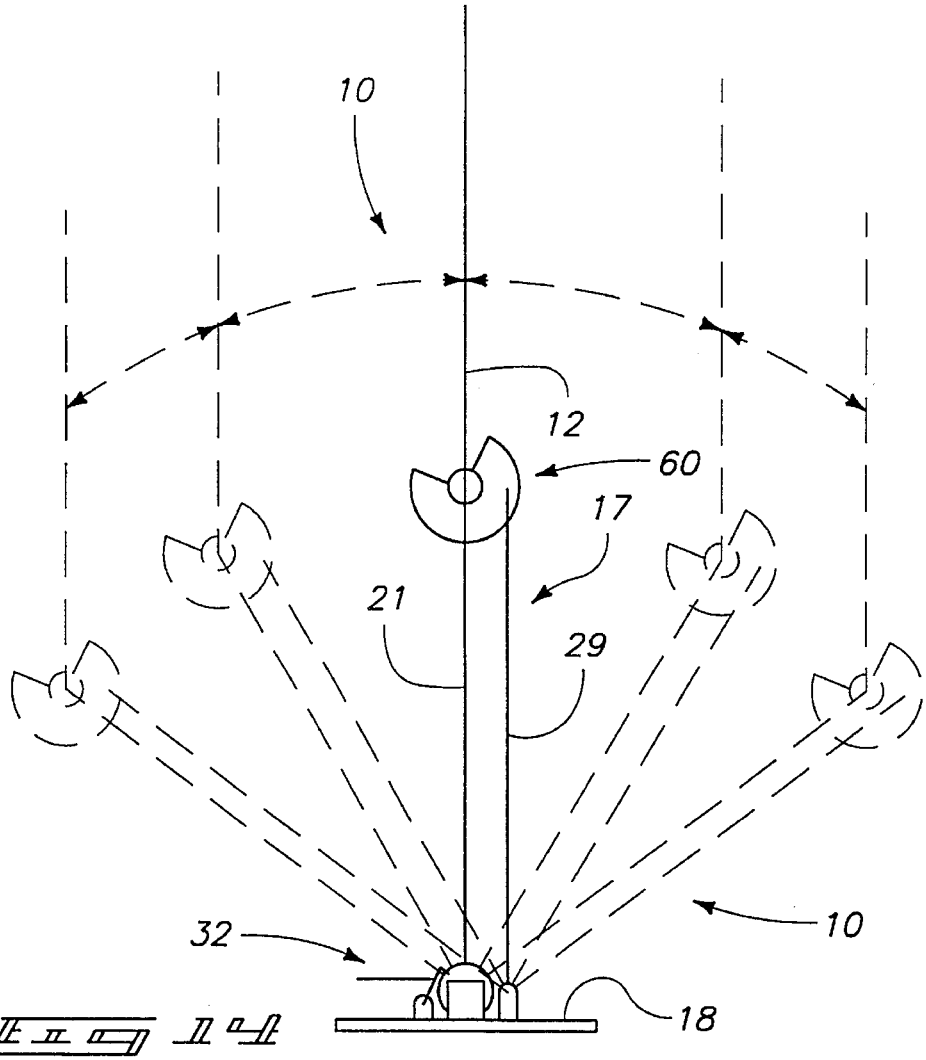
FIGS. 14–17 are diagrammatic views showing various adjusted positions for the preferred sports target frame.

FIGS. 11–13 show an accessory that allows usage of the target frame for basketball competition or practice. A basketball backboard 70 is shown attached to the uprights 12 in FIG. 11. The backboard 70 is provided with a target in the form of a net 71 on one side, and a pair of mounting pins 72 on the opposite side.

The pins 72 are spaced apart to be slidably received within open upper ends of the uprights 12. They allow the backboard to be easily attached to the uprights, and securely hold the backboard in position. A lower edge of the backboard is slotted to accommodate the adjustment flange 61.

In the basketball configuration, the platform 42 is folded as shown in FIG. 11 to gain basket elevation and to provide stable support of the elevated backboard. A weight 75, provided by the user can be positioned on the floor engaging part of the platform for added stability. If used outdoors, stakes may be driven into the ground and attached to the platform to provide such additional stability.

The platform 42 may be locked in the basketball configuration using a pin and aperture arrangement shown at 76 in FIGS. 6, 9, and 11 provided in the side walls of the platform sections. Removal of the pins will enable the platform 42 to be folded between the positions shown in the successive FIGS. 6, 9, and 11.

Operation of the present sports target frame may now be understood.

Prior to operation, the user unfolds the target frame 10 from the storage position shown in FIG. 6. This is done simply by depressing the pedal 36 to disengage the locking dog 34, and by swinging the base standards 21 upwardly to a desired angular position. The pedal 36 is then released to lock the goal in the selected position. The platform is also folded out to the flat condition shown in FIG. 9.

If football kicking practice is desired, the user swings the uprights 12 to a vertical position, then attaches the clevis 63 to the flange 61 by sliding the pin 64 through the appropriately aligned clevis apertures and flange hole 62.

In the embodiment in which the platform is used, the platform sections, tether 48 and selected projectile (football 11) are assembled in the configuration shown in FIG. 9. The ball 11 is then placed on the tee and the goal is ready for use.

The ball 11 is kicked forcefully toward the net 13 between the uprights 12. After the ball reaches the end of the inelastic part 50 of the tether 48 and beyond, the elastic part 49 will begin to stretch. The amount of stretch depends upon the force with which the ball is kicked, and the length of the elastic part 49. When the energy of the ball becomes fully stored in the elastic part 49, the ball will stop its forward progress.

The stored energy in the elastic part 49 is next spent contracting the elastic part and pulling the ball back to the location of the user. This will happen whether the kicker has "scored" or not. The returned ball is then picked up and placed on the tee 46 for the next kick.

If the user wishes to change the simulated distance for the kick, he or she simply again depresses the pedal 36 and adjusts the goal to the desired position. The base standards 21 are shifted toward the tee for shorter kicks, or away from the tee for longer kicks. The tether and elastic part length remain constant, so the kicker is forced to accommodate by controlling the force of the kick. A longer kick requires greater kicking force and a shorter kick requires less.

To adjust the frame to the configuration shown in FIG. 5 or to the positions shown in FIGS. 15 and 17, for use in soccer, tennis, golf, baseball or other low target sport, several simple steps are taken. Firstly, the base standards 21 are pivoted toward the remote platform end 45. This is done by first stepping on the pedal 36 to release the locking dog 34. This frees the base standards 21 to swing forwardly. When the desired angle is reached, the pedal is released and the locking dog will slip into the appropriate notch in the cog wheel 33, locking the standards 21 at the selected angular position.

Next the pin 64 is removed from the clevis 63, to allow the uprights 12 to swing down to a selected position. The pin 64 is slipped back through the clevis holes and the appropriately aligned hole in the flange 61, locking the uprights in the desired position. The target frame is now adjusted to present the target net for use with the selected sport.

The user may also wish to change from the football to another projectile more specific to the ground goal configuration. This is done simply by disconnecting the present projectile from the clip 47. The other selected projectile may then be exchanged for the football, to be thrown, kicked, struck or otherwise forcefully launched, again with the objective of hitting the net 13. If used, the tether will operate in the same way indicated above.

FIGS. 2–5, and 14–17 all show different angular adjustments for the standards 21 and uprights 12. Such adjustments may be made using variations of the steps indicated above, to accommodate competition or practice in numerous sports activities, whether the tether is or is not selected for use.

The basketball backboard 70 may be placed on the uprights with the frame adjusted to the positions shown in FIGS. 2 or 3 for small players. This is done simply by lifting the backboard 70 over the uprights and then lowering it so the mounting pins 72 are received in the open upper ends of the uprights 12. The frame is now ready for use for basketball competition or practice.

The present sports target frame may also be configured for competition or practicing basketball for taller players, as shown in FIG. 11. To fold the frame to this basketball configuration, the pedal 36 and upright adjustment means 60 are operated generally as described above, to shift the standards 21 and uprights 12 to the position generally shown by dashed lines at the far right in FIG. 16.

To further elevate the frame, the platform 42 is folded to the orientation shown in FIG. 11. This is done by swinging the platform section 44 downward (from the position shown in FIG. 9) to be locked in place at an acute angle to the platform section 43 (FIG. 11), using the pin and aperture arrangement 76. The folded frame is then tipped up to the FIG. 11 orientation, with the platform section engaging the support surface. A weight 75 may then be placed on the platform section 43 to secure the frame against tipping. The basketball backboard 70 is attached as described above and the frame is ready for basketball competition or practice.

When the practice or game is finished, the user may fold the components simply by reversing the assembly steps, returning the goal to its storage condition as shown in FIG. 6.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A portable sports target frame, comprising:

a base;

a base standard including a bottom end and a top end;

said base standard being mounted to the base for pivotal movement about a first horizontal axis;

an elongated cross member mounted to the base standard at the top end substantially parallel to the first horizontal axis;

uprights mounted to the opposed cross member ends;

a platform mounted to the base and including a remote end; and wherein the platform is provided in foldable sections such that the platform may be selectively folded to a storage condition or to provide adjustable support for the standard, cross member, and uprights for various sport activities.

2. A portable sports target frame as claimed by claim 1, further comprising:

a latch mounted between the base standard and base, selectively locking the base standard at a selected angular position about the first horizontal axis.

3. A portable sports target frame as claimed by claim 1, further comprising:

angular adjustment means on the uprights and cross member for selective pivotal adjustment of the cross member and uprights.

4. A portable sports target frame as claimed by claim 1, further comprising:

a basketball backboard removably mounted to the uprights.

5. A portable sports target frame as claimed by claim 1, wherein the platform is provided in two foldable sections; and further comprising a basketball backboard removably mounted to the uprights.

6. A portable sports target frame as claimed by claim 1, further comprising:

a tee mount on the platform adjacent the remote end;

a projectile; and a tether mounted to the projectile and platform, said tether having a length dimension at most equal to a distance from the tee to the cross member.

7. A portable sports target frame as claimed by claim 1, further comprising:

a tee mount on the platform adjacent the remote end;

a projectile;

a tether mounted to the projectile and platform, said tether having a length dimension at most equal to a distance from the tee mount to the cross member; and wherein the tether includes an elastic part.

8. A portable sports target frame as claimed by claim 1, further comprising:

wherein the platform extends from the base to a remote end;

a projectile;

a tether mounted to the projectile and platform, said tether having a length dimension at most equal to a distance from the remote end to the cross member;

wherein the tether includes an elastic part and an inelastic part; and wherein the elastic part of the tether is mounted to the platform.

9. A portable sports target frame comprising:

a base;

an elongated cross member having opposed ends;

uprights mounted to the cross member;

a parallelogram linkage mounting the elongated cross member to the base for pivotal movement and maintaining the uprights in substantially consistent angular orientations;

wherein the parallelogram linkage includes a base standard pivotably mounted to the base; and angular adjustment means operably mounted between the cross member and base standard for angularly adjusting the uprights and cross member relative to the base.

10. A portable sports target frame as claimed by claim 9, and further comprising:

a latch mounted between the base standard and base, selectively locking the base standard at a selected angular position.

11. A portable sports target frame as claimed by claim 9, further comprising:

a platform mounted to the base.

12. A portable sports target frame as claimed by claim 9, further comprising:

a basketball backboard releasably mounted to the uprights.

13. A portable sports target frame as claimed by claim 9, further comprising:

a platform mounted to the base and extending to a remote end;

wherein the platform is provided in two foldable sections; and a pin and aperture means on the foldable sections for locking the foldable sections in a prescribed angular orientation.

14. A portable sports target frame as claimed by claim 9, further comprising:

a platform mounted to the base and extending to a remote end;

a projectile; and a tether connecting the projectile and platform.

15. A portable sports target frame as claimed by claim 9, further comprising:

a platform mounted to the base and extending to a remote end;

a tether mounted to the platform; and wherein the tether includes an elastic part.

16. A portable sports target frame as claimed by claim 9, further comprising:

a platform mounted to the base and extending to a remote end;

a tether mounted to the platform for attachment to a projectile wherein the tether includes an elastic part and an inelastic part; and wherein the elastic part of the tether is mounted to the platform.

17. A portable sports target frame, comprising:

a base;

a base standard including a bottom end and a top end;

said base standard being mounted to the base for pivotal movement about a first horizontal axis;

a cross member fitting on the top end of the base standard;

a cross member pivotably mounted to the cross member fitting for pivotal movement about a second horizontal axis substantially parallel to the first axis and spaced by a first distance from the first axis;

uprights mounted to the opposed cross member ends;

a stabilizing link;

parallelogram connectors on the cross member and base pivotably mounting the stabilizing link to the cross member and base about substantially parallel third and fourth axes;

adjustment means connecting the cross member and stabilizing link for selective angular positioning of the cross member about the second axis;

wherein the third and fourth axes are spaced apart by a second distance substantially equal to the first distance;

wherein the first and third axes are spaced apart by a third distance; and wherein the second and fourth axes are spaced apart by a fourth distance substantially equal to the third distance.

18. A portable sports target frame as claimed by claim 17, further comprising:

a latch mounted between the base standard and base, selectively locking the base standard at a selected angular position about the first horizontal axis.

19. A portable sports target frame as claimed by claim 17, further comprising:

a platform mounted to the base.

20. A portable sports target frame as claimed by claim 17, further comprising:

a basketball backboard releasably mounted to the uprights.

21. A portable sports target frame as claimed by claim 17, further comprising:

a platform mounted to the base and including a remote end; and a tether mounted to the platform, said tether having a length dimension at most equal to a distance from the remote end to the cross member.

22. A portable sports target frame as claimed by claim 17, further comprising:

a platform mounted to the base and including a remote end;

a tether mounted to the projectile and platform, said tether having a length dimension at most equal to a distance from the remote end to the cross member; and wherein the tether includes an elastic part.

23. A portable sports target frame as claimed by claim 17, further comprising:

a platform mounted to the base and including a remote end;

a tether mounted to the platform, said tether having a length dimension at most equal to a distance from the remote end to the cross member;

wherein the tether includes an elastic part and an inelastic part; and wherein the elastic part of the tether is mounted to the platform and the inelastic part is connectable to a projectile.

* * * * *